US006677845B1

(12) United States Patent
Fader et al.

(10) Patent No.: US 6,677,845 B1
(45) Date of Patent: Jan. 13, 2004

(54) MAGNETIC PICK-UP TOOL

(75) Inventors: Aaron E. Fader, Scottsdale, AZ (US); Mark Franklin Reynolds, Lansley (CA)

(73) Assignee: Summit Tool Company, Akron, OH (US)

( * ) Notice: Subject to any disclaimer, the term of this patent is extended or adjusted under 35 U.S.C. 154(b) by 0 days.

(21) Appl. No.: 09/487,030

(22) Filed: Jan. 19, 2000

(51) Int. Cl.[7] ..... H01F 7/20
(52) U.S. Cl. ..... 335/285; 294/65.5
(58) Field of Search ..... 335/285–306; 294/65.5, 88; 81/24

(56) References Cited

U.S. PATENT DOCUMENTS 2,878,342 A * 3/1959 Arthur ..... 335/305
2,947,563 A * 8/1960 Stitt ..... 294/65.5
3,041,697 A 7/1962 Budrek
4,373,967 A * 2/1983 Roper, Jr. et al. ..... 148/2
5,821,840 * 10/1998 Ricker ..... 335/128
5,945,901 8/1999 Coleman, Jr. et al.

* cited by examiner

*Primary Examiner*—Ramon M. Barrera
(74) *Attorney, Agent, or Firm*—Renner, Kenner, Greive, Bobak, Taylor & Weber

(57) ABSTRACT

A magnetic pick-up tool, which preferably features a magnet retained on its non-exposed sides within a ferrous-containing carrier. The ferrous-containing carrier redirects the magnetic forces issuing from the magnet toward the exposed surface area, significantly increasing a magnet's strength without the need for increasing magnet size. In one embodiment, the pick-up tool features a threaded carrier, mated to a sleeve member in a manner allowing the sleeve member to be adjustably positioned relative to the magnet and carrier by rotation of the sleeve member in the desired direction.

2 Claims, 1 Drawing Sheet

MAGNETIC PICK-UP TOOL

FIELD OF THE INVENTION

This invention relates generally to pick-up tools and, more specifically, to an improved magnetic pick-up tool having increased pick-up strength and flexibility of use.

BACKGROUND OF THE INVENTION

Magnetic pick-up tools are generally known in the art. Typically, these tools feature a cylinder-shaped magnet housed in an aluminum carrier or jacket, with a telescoping shaft being inserted into a rear portion of the magnet (or carrier) to allow the tools to be used in difficult-to-reach areas. The most common use for such tools is in the field of vehicle repair, although many other uses are possible.

U.S. Pat. No. 5,945,901 issued to Coleman illustrates one such tool. The tool of Coleman further features a ferromagnetic sleeve member that is slidably positioned about the magnet (or carrier), with the sleeve member being held in position by magnetic forces emanating from the sides of the magnetic. The Coleman tool further features an arrangement in which the sleeve member extends beyond the exposed surface area of the magnet, to eliminate or reduce the possibility that the exposed magnet surface will unintentionally attract radially positioned objects.

There are several drawbacks with the prior art tools, including the Coleman tool, however. With specific regard to the Coleman tool, it discloses a pick-up tool having a magnet holder (i.e., carrier) comprising a non-ferrous material, such as aluminum, brass, plastic, or non-magnetic stainless steel. Such a holder does not interfere with flux from the magnet, so that the sleeve member car still be retained in position by the magnet despite the presence of the holder/carrier.

However, because the non-ferrous magnet holder/carrier does not interfere with flux from the magnet, it does not redirect flux from the magnet in the direction of the exposed surface area and thus results in a magnet having less than optimal strength. Moreover, some users find the slidable sleeve member to be a nuisance, and want the flexibility of being able to adjust the amount by which the sleeve member extends beyond the surface of the magnet, or to retract the sleeve member so that it does not extend beyond the surface of the magnet at all.

A need therefore existed for a magnetic pick-up tool capable of using magnets of the size typically used in prior art tools, yet having significantly increased pick-up strength. A need further existed for a magnetic pick-up tool having an adjustable sleeve member.

SUMMARY OF THE INVENTION

It is an object of this invention to provide a magnetic pick-up tool capable of using magnets of the size typically used in prior art tools, yet having significantly increased pick-up strength.

It is a further object of this invention to provide a magnetic pick-up tool having an adjustable sleeve member.

BRIEF DESCRIPTION OF THE PREFERRED EMBODIMENTS

In accordance with one embodiment of the present invention, a magnetic pick-up tool assembly is disclosed. The assembly comprises, in combination: a magnet having an exposed pick-up area, a rear area opposite the exposed pick-up area, and side surface areas disposed between the exposed pick-up area and the rear area; a carrier fixedly coupled to the side surface areas of the magnet; wherein the carrier comprises a ferrous-containing material; and a shaft attached to at least one of the rear area and the carrier.

In accordance with another embodiment of the present invention, a magnetic pick-up tool assembly is disclosed. The assembly comprises, in combination: a magnet having an exposed pick-up area, a rear area opposite the exposed pick-up area, and side surface areas disposed between the exposed pick-up area and the rear area; a carrier fixedly coupled to the side surface areas of the magnet; wherein an exterior surface of the carrier is threaded; a ring adapted to engage the threaded exterior surface of the carrier so that a position of the ring relative to the magnet may be altered by rotating the ring about the carrier; and a shaft attached to at least one of the rear area and the carrier.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
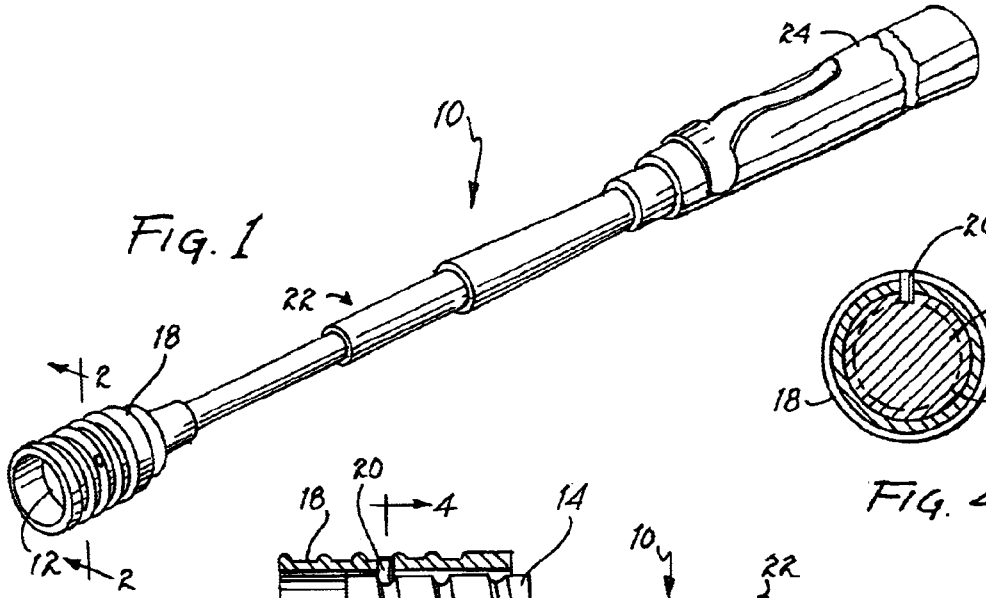
FIG. 1 is a perspective view of an embodiment of the magnetic pick-up tool assembly of the present invention.
Figure 4:
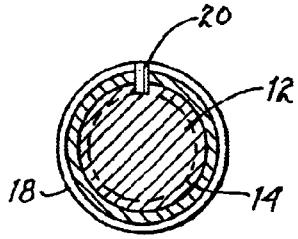
FIG. 4 is a cross-sectional view of the magnetic pick-up tool assembly of FIG. 2, taken along line 4—4.
Figure 2:
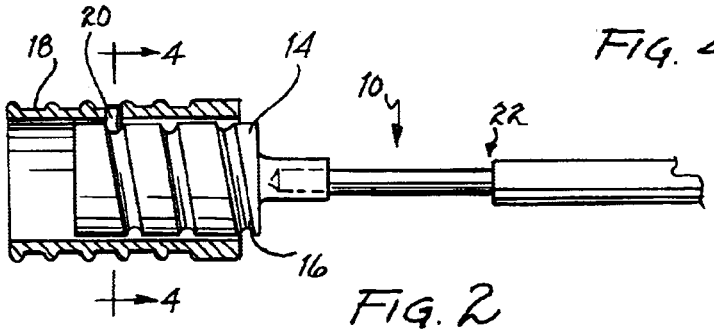
FIG. 2 is a side, cross-sectional view of the magnetic pick-up tool assembly of FIG. 1, taken along line 2—2.
Figure 3:
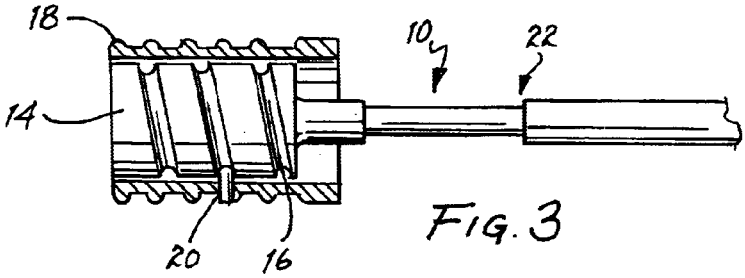
FIG. 3 is a side, cross-sectional view of the magnetic pick-up tool assembly of FIG. 1, taken along line 2—2 and illustrating the movement of the sleeve member from the position in FIG. 2 to that shown in FIG. 3.

Referring first to FIGS. 1–3, reference number 10 refers generally to one embodiment of the magnetic pick-up tool assembly of the present invention. The pick-up tool assembly 10 generally comprises a magnet 12 which is covered by a carrier 14. (Preferably, the carrier is dimensioned to cover at least the side areas of the magnet 12 and the non-exposed rear surface of the magnet 12 as well, and is adhered to the magnet 12 using a glue-type adhesive.) As shown in this embodiment, the magnet 12 and carrier 14 are preferably cylindrical in configuration, although other shapes for each are certainly permissible without departing from the spirit or scope of the present invention—provided of course that the carrier 14 appropriately mates with the magnet 12 so as to redirect the side and rear magnetic forces of the magnet 12 to its exposed surface.)

Referring specifically to FIGS. 2 and 3, the carrier 14 in one embodiment has threading 16, which enables the carrier 14 to be coupled to a sleeve member 18 in a manner allowing the sleeve member 18 to be moved in either direction along the carrier 14 by rotating the sleeve member 18. In this embodiment, the sleeve member 18 has a projection 20 that inserts into the threading 16, so that upon rotation of the sleeve member 18, the projection 20 travels along the threading 16 in the desired direction—causing the sleeve member 18 to change position, as desired, relative to the carrier 14. In this manner, the sleeve member 18 can be positioned to extend beyond the exposed surface of the magnet 12 by the amount desired as shown in FIG. 2, or the sleeve member 18 can positioned so as to be flush with the exposed surface of the magnet 12 as shown in FIG. 3. Also in this embodiment, because the sleeve member 18 is not retained in position by magnetic force from the magnet 12, the sleeve member 18 can be manufactured from a non-ferrous material.

Figure 5:
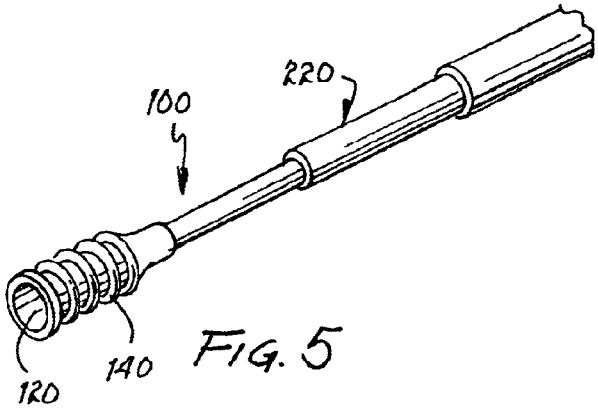
FIG. 5 is a perspective view of another embodiment of the magnetic pick-up tool assembly of the present invention.
Figure 6:
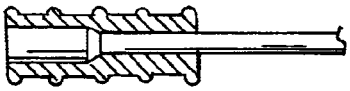

Referring now to FIG. 5, another embodiment of the pick-up tool assembly 10 is shown, referred to as the pick-up tool assembly 100. Like the pick-up tool assembly 10 described above, the pick-up tool assembly 100 generally comprises a magnet 120 which is covered by a carrier 140 in the manner described above with respect to the magnet 12 and carrier 14. In this embodiment, there is no equivalent for the sleeve member 18.

As shown in FIGS. 2 and 3, a telescoping shaft 22 is preferably coupled to the carrier 14 at a side opposite the exposed surface of the magnet 12. The telescoping shaft 22 may be positioned, as desired, taking into account the distance needed to be covered by the pick-up tool assembly 10. (While the shaft 22 is shown as being of the telescoping variety, a non-telescoping shaft 22 would also be suitable.) As shown in FIG. 1, a handle 24 is preferably positioned at the end of the telescoping shaft 22 opposite the carrier 14. With respect to the pick-up tool assembly 100, it also preferably features a telescoping shaft, identified in this embodiment by reference number 220.

Referring to FIGS. 1–5, in a preferred embodiment the carrier 14 and carrier 140 is made of a ferrous-containing material, which will have the effect of redirecting side and, if the carrier covers the rear unexposed surface of the magnet 12 (or magnet 120), rear magnetic forces toward the exposed surface of the magnet 12 (or magnet 120). The ferrous-containing material is preferably any mild steel and, in the preferred embodiment, is C12L14 low carbon re-sulfurized freemachining steel of the type available from British Steel Alloys. It is believed that any metal having a relatively high content of manganese and/or iron, when formed into the carrier 14 (or carrier 140), will yield significant benefit over prior art non-ferrous carriers, and the term "ferrous-containing material" as used herein is to be construed broadly to encompass any such material.

Tests of a pick-up tool assembly 10 having a cylindrical magnet 12 with a thickness of 0.375" and a diameter of 0.5" and housed in a carrier 140 comprised of C12L14 low carbon resulfurized free machining steel showed a maximum pick-up capacity for the magnet 120 of approximately 14.30 pounds. Using the same size and type of magnet 120 but with a carrier 140 comprised of 2011TC aluminum—a material typical of that commonly used in carriers of the prior art assemblies—a maximum pick-up capacity of approximately 8.97 pounds resulted. Thus, the change in material in the carrier 140 of the present invention resulted in an increase in pick-up capacity of approximately 62.73%—without any change in the size of the magnet 12 used.

While in the embodiment of FIG. 5 the carrier 140 comprises a ferrous-containing material, in the embodiment of FIGS. 1–4 the carrier 14 may be of either the ferrous or non-ferrous variety. While use of a non-ferrous material in the manufacture of the carrier 14 will not result in the increased magnet strength described above, the adjustability of the sleeve member 18 relative to the carrier 14 having threading 16 will still yield substantial benefit over the prior art with respect to the ability to adjust the position of the sleeve member 18 as desired.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A magnetic pick-up tool assembly comprising, in combination:

a magnet having an exposed pick-up area, a rear area opposite said exposed pick-up area, and side surface areas disposed between said exposed pick-up area and said rear area;

a carrier fixedly coupled to said side surface-areas of said magnet;

wherein said carrier comprises a ferrous-containing material;

wherein an exterior surface of said carrier is threaded and wherein said assembly further comprises a ring adapted to engage said threaded exterior surface of said carrier so that a position of said ring relative to said magnet may be altered by rotating said ring about said carrier; and a telescoping shaft attached to at least one of said rear area and said carrier.

2. A magnetic pick-up tool assembly comprising, in combination:

a magnet having an exposed pick-up area, a rear area opposite said exposed pick-up area, and side surface areas disposed between said exposed pick-up area and said rear area;

a carrier fixedly coupled to said side surface areas of said magnet;

wherein an exterior surface of said carrier is threaded;

a ring adapted to engage said threaded exterior surface of said carrier so that a position of said ring relative to said magnet may be altered by rotating said ring about said carrier; and a telescoping shaft attached to at least one of said rear area and said carrier.

* * * * *